US012577791B2

(12) United States Patent
Spiers

(10) Patent No.: US 12,577,791 B2
(45) Date of Patent: Mar. 17, 2026

(54) SYSTEM OF STRUCTURAL SUPPORT FRAMEWORK FOR ELEVATED FLOORING

(71) Applicant: Designer Deck Inc., Concord (CA)

(72) Inventor: David Spiers, Concord (CA)

(73) Assignee: Designer Deck Inc., Concord (CA)

( * ) Notice: Subject to any disclaimer, the term of this patent is extended or adjusted under 35 U.S.C. 154(b) by 265 days.

(21) Appl. No.: 18/232,014

(22) Filed: Aug. 9, 2023

(65) Prior Publication Data

US 2025/0052072 A1 Feb. 13, 2025

(51) Int. Cl.
*E04F 15/024* (2006.01)

(52) U.S. Cl.
CPC .... *E04F 15/02458* (2013.01); *E04F 15/0247* (2013.01)

(58) Field of Classification Search
CPC . E04F 15/0247; E04F 15/02458; E04F 15/24; E04F 15/02411; E04F 15/02417; E04F 15/02447; E04F 15/02452; E04F 15/02482; E04F 15/02494; E04D 11/007; H02G 3/285; H02G 3/385; E04B 5/48; E04B 9/12; E04B 9/125; E04B 9/127; E04B 9/16
See application file for complete search history.

(56) References Cited

U.S. PATENT DOCUMENTS 1,061,658 A 5/1913 Bradshaw
3,310,922 A * 3/1967 Hoffmann, Jr. ..... E04B 9/122 52/506.06
3,324,614 A * 6/1967 Loewenau ..... E04F 15/0247 52/126.6
3,398,933 A 8/1968 Haroldson
3,606,704 A * 9/1971 Denton ..... E04F 15/02452 403/138
3,645,054 A 2/1972 Olvera
(Continued)

FOREIGN PATENT DOCUMENTS

CA 2419381 A1 5/2003
CA 3142403 A1 6/2023
(Continued)

OTHER PUBLICATIONS

Office Action issued in related CA patent application serial No. 3,142,403, dated Jun. 7, 2023.

*Primary Examiner* — Kyle J. Walraed-Sullivan
(74) *Attorney, Agent, or Firm* — Westman, Champlin & Koehler, P.A.; Amanda M. Prose

(57) ABSTRACT

The present invention pertains to a system of structural support framework that can be applied for elevated flooring. The system incorporates a plurality of base frameworks constructed of top rails, bottom rails, rivets and a plurality of foots being laid adjacently over a fixed surface. The adjacent base frameworks are connected with spacers. A tile can be conveniently disposed over the finished system. The system also incorporates a free-support which can be employed in spaces where the base framework is altered for additional support. The present system of structural support framework further integrates a height levelling mechanism and ensures a spirit-level finished elevated flooring. The system can be conveniently deconstructed without demolishing the components and can be recycled or reused.

20 Claims, 9 Drawing Sheets

(56) References Cited

U.S. PATENT DOCUMENTS 3,835,614 A * 9/1974 Downing, Jr. ..... E04B 9/122 52/666
3,899,857 A * 8/1975 Mochizuki ..... E04F 15/02452 52/347
4,364,215 A * 12/1982 Gailey ..... E04B 9/065 52/506.08
4,658,562 A * 4/1987 Brugman ..... E04B 9/127 52/665
4,685,258 A 8/1987 Av-Zuk
4,757,663 A * 7/1988 Kuhr ..... E04B 9/16 52/664
4,827,687 A * 5/1989 Frawley ..... E04B 9/245 52/473
5,333,423 A 8/1994 Propst
5,465,534 A * 11/1995 Mittag ..... E04F 15/02458 D25/138
5,588,264 A 12/1996 Buzon
6,345,474 B1 2/2002 Triplett
6,363,685 B1 4/2002 Kugler
9,416,536 B1 * 8/2016 Lehane ..... E04B 9/183
10,570,626 B1 * 2/2020 Kim ..... E04F 15/02458
10,683,664 B2 * 6/2020 Langeveld ..... E04B 9/366
10,920,430 B1 * 2/2021 Kim ..... E04F 15/02405
2009/0282766 A1 * 11/2009 Roen ..... E04B 5/48 52/506.08
2017/0167150 A1 * 6/2017 Buzon ..... E04F 15/02183
2020/0389004 A1 * 12/2020 Chen ..... H02G 3/385
2021/0164224 A1 * 6/2021 Kim ..... E04B 5/023
2021/0285235 A1 * 9/2021 Majewski ..... E04F 15/0247
2022/0112729 A1 * 4/2022 Chen ..... E04F 15/02452

FOREIGN PATENT DOCUMENTS

DE 202011109402 U1 * 1/2012 ..... E04F 15/02452
EP 1760222 A2 * 3/2007 ..... E04F 15/02476
FR 2905395 A1 * 3/2008 ..... E04F 15/02482
FR 3017146 A1 * 8/2015 ..... E04F 15/02464
GB 2225037 A * 5/1990 ..... E04B 9/24
GB 2310227 A * 8/1997 ..... E04F 15/22
GB 2312994 A * 11/1997 ..... H02G 3/285
GB 2630135 A * 11/2024 ..... E04F 15/06
WO WO-0211260 A2 * 2/2002 ..... H02G 3/285

* cited by examiner

SYSTEM OF STRUCTURAL SUPPORT FRAMEWORK FOR ELEVATED FLOORING

BACKGROUND

Conventional residential and commercial flooring systems typically involve a rough unlevelled fixed surface called a subfloor which could be a concrete slab or a plywood board onto which a finished flooring is applied. Flooring is classified into resilient and nonresilient flooring types. Both resilient and non-resilient flooring types are further classified into carpet style, laminate style and tile style flooring. The tile style flooring typically involves an application of a thick layer of adhesives, thin-sets or mortars etc. to act as a bonding agent between the top surface of the subfloor and the bottom surface of a tile. A tile is then laid and pressed against the subfloor and requires manual leveling of the tile in all dimensions using manual force. A plurality of the tiles is laid adjacent to each other with uniform gaps between the edges and is left over time for the bonding agent to dry. Once the bonding agent is dry, a grout-mix is used to fill the gaps between the tiles. This type of flooring can be utilized in indoor and outdoor applications. The flooring in outdoors applications such as decks, patios, balconies, terraces, front and backyards etc., is usually constructed using a variation of the tile style flooring system. The challenges possessed by this system range from costs, ease of construction, limited material availability, heavy manual labor, renovation options, construction limitations by code, weather conditions etc. A special type of tile viz. a non-glazed porcelain tile or a concrete slab is required in outdoor applications due to the possible climatic changes such as extreme hot and cold conditions, frost or heaving that might affect the longevity of the tile. These tiles are usually 1" thick and at least 2 ft×2 ft in dimensions requiring a levelled foundation either with screening material, styrofoam sheets or adjustable height pedestals to be installed. These tiles are costlier and comparatively heavier to both handle and ship due to the required thickness. The logistics, load and labor required for the construction significantly affects the overall cost. A spirit level finish can also be difficult to achieve since the tiles need to be manually leveled in addition to the foundation or material it sits upon. Replacement of the constructed flooring in indoor applications require heavy demolition as the entire flooring needs to be demolished from the bottom layer of bonding agent to the tile. The replacement of a constructed flooring in the outdoor applications requires the tiles to be extricated off of the foundation or material below. The heavy tiling members need to be manually lifted and the foundation needs to be cleaned and cleared. Certain outdoor applications require the flooring to be raised in order to accommodate height codes, if applicable and for air and water flow. This type of raised flooring requires extra materials or parts and can become extremely costly. Average cost of constructing this style of tile flooring for indoor application ranges from $5-$30 per Sq.Ft including material and labor in Canada and USA for indoor applications. The average cost of constructing a this style of tile flooring for outdoor application ranges from $20-$45 per Sq.Ft including material and labor in Canada and USA. Typical commercial applications like offices, schools, data centers, casinos, event spaces etc. employ a false flooring which aids in mechanical, electrical, air and water supply and maintenance. The current market provides numerous solutions for raised flooring that employ metal or plastic fabricated support pedestals as the support base and usually use steel, concrete tiles as panels. These solutions possess challenges ranging from costs, finished material availability, material limitations, weight requirements, etc.

RELATED ART

U.S. Pat. No. 1,061,658 described by Bradshaw;
U.S. Pat. No. 3,398,933 described by Haroldson;
U.S. Pat. No. 3,645,054 described by Olvera;
U.S. Pat. No. 4,685,258 described by Av-Zuk;
U.S. Pat. No. 5,333,423 described by Albrecht;
U.S. Pat. No. 5,588,264 described by Buzon;
U.S. Pat. No. 6,345,474 described by Triplett;
U.S. Pat. No. 6,363,685 described by Kugler;
C.A 241,938 A described by Carlson;

The above-mentioned prior arts include a variety of adjustable structural supports, levelling apparatus, deck supports, floor panel supports, adjustable pier blocks etc., there still exists a need for a simple support system which can be used, for false flooring, decks, balconies, flat roofs, etc. The necessity specifically pertains towards the longevity and integrity of tiles, ease of application and installation, construction and maintenance costs.

The object of the present invention is an easy to construct piece-by-piece system of assembly. No bonding agents are required in this system. The system integrates a height leveling mechanism, which ensures accurate height calibration resulting in a spirit level finished floor. Any size or material of tile can be used in this application since the assembly is slightly raised above the foundation it sits upon and the tile has enough room to contract and expand due to climatic changes. The construction of this system involves a two-step process. The first step involves assembling the components of the system to embody a plurality of base frameworks that is laid and interconnected adjacently over the area to be covered. The base frameworks can also be altered in order to accommodate shape and dimension of the surface area. The second step is to simply install the tiles in position by laying them on the corresponding framework. A completely assembled system concludes a spirit-levelled finished flooring. The tiles can be removed and replaced anytime conveniently since they are not permanently bonded with the framework. This system further provides room for air and water flow underneath and in between the gaps of the assembled floor, so that the elements may move freely thus preserving the longevity of the tiles and the foundation this system sits upon by avoiding ponding, rot, mildew and fungal growth. The cost to construct this system is almost half the price of a traditional tile flooring system used outdoors and considerably cheaper than the current system used in indoor applications for elevated flooring. This system can also be deconstructed without demolishing any component and can be reused, recycled and accessed for ease in maintenance or additional renovations at a later date.

DESCRIPTION

The following detailed description is of the best currently contemplated models of the invention. The description is not to be taken in a limiting sense but is made merely for the purpose of illustrating the general principles of the invention. The scope of the invention is best defined by appended claims.

The described features, structures, or characteristics of the invention may be combined in any suitable manner in one or more embodiments. In the following description, numerous specific details are provided, such as examples of assembling the components, materials and fabrication of components, varying dimensions of components, varying steps of framework assembly etc., to provide a thorough understanding of embodiments of the invention. A person skilled in the relevant art will recognize, however, that the invention can be practiced without one or more of the components or with other methods of assembly of the components, steps of assembling the components and so forth. In other instances, well-known applications of the invention are not shown or described in detail to avoid obscuring aspects of the invention.

The term 'top' used in the following description refers to as the plane, surface or part facing towards or pointing at or closer to the ceiling, roof or sky. The term 'bottom' used in the following description refers to as the plane, surface or part facing or pointing at or closer to the ground, base or the foundation. The term 'uniform interval' used in the following description to be taken in a sense wherein given four points a, b, c, and d are located such that the distance between a and b is equal to the distance between b and c which is equal to the distance between c and d, then points a, b, c and d are located at a uniform interval.

IN THE DRAWINGS

The present invention describes the components and assembly of a system of structural support framework for elevated flooring. The invention specifically pertains to a system for tiled flooring that can be constructed by assembling the components together to form a base framework onto which aw tile can be disposed. A top rail, a bottom rail, a rivet, a foot, a spacer, and a free-support collectively define the components of the embodiment. The said components are constructed to embody a system of structural support framework onto which a tile of any size, shape and material can be disposed. The embodiments of the invention can be applied for indoors or outdoors applications and for residential or commercial spaces.

Components and Method of Construction of the Invention According to the Present Embodiment.

Figure 1:
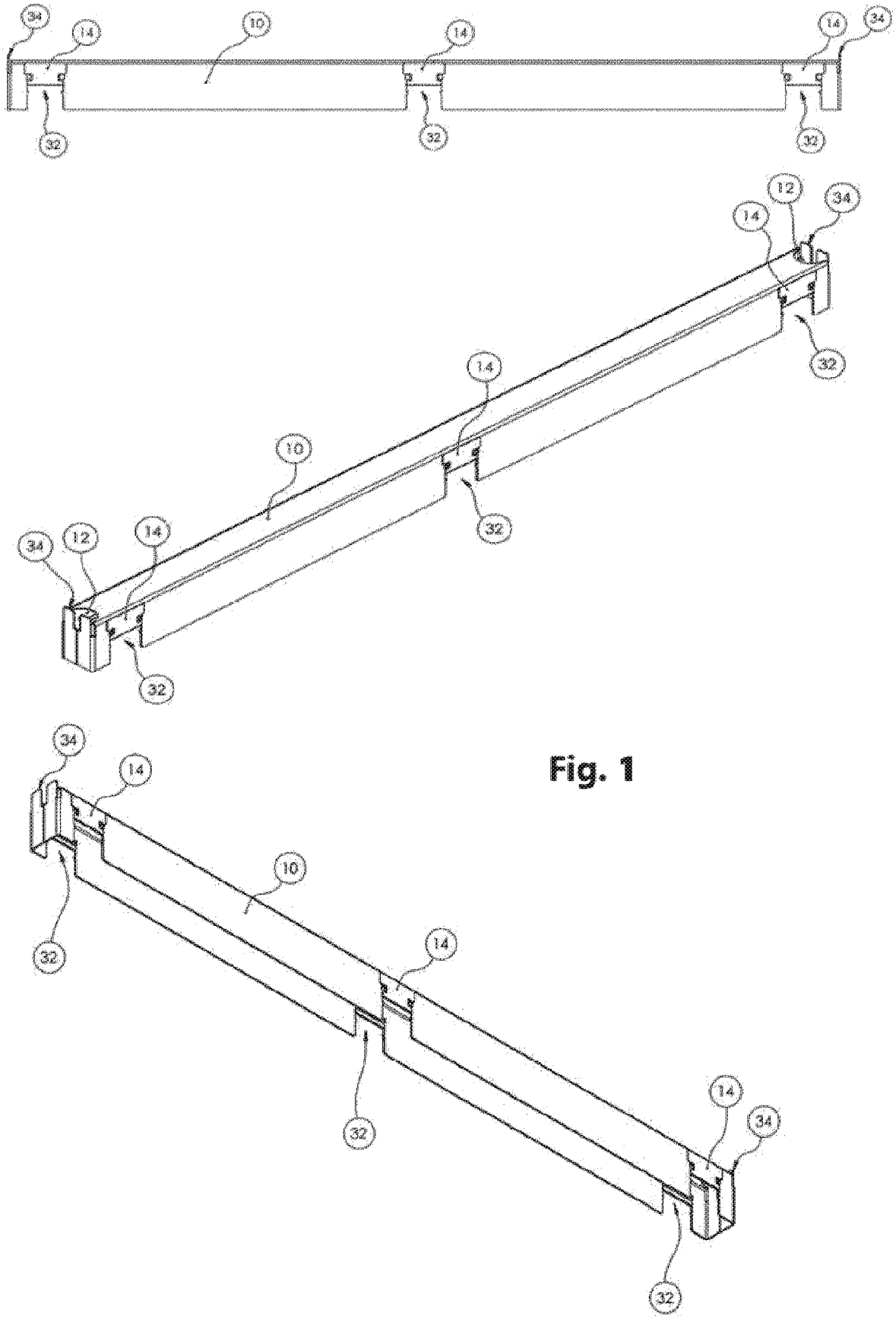
FIG. 1 represents a side orthographic view and a top and bottom perspective view of the top rail.

FIG. 1 shows a top rail 10. The top rail 10 possesses a first short side and a second short side connected by two opposite long sides and a top side in fabrication to embody a five-sided elongated strip with flat surfaces and a hollow cavity opening through the bottom defining a length, a width, and a height. The top rail 10 possesses three pairs of cut-outs 32 positioned coincidentally on the two opposite long sides along the hollow cavity such that two pairs of coincidental cut-outs 32 are positioned near the first short side and the second short side, and one pair of coincidental cut-outs 32 is positioned approximately at the center of the top rail 10. A tape 14 fabricated of shock-absorbing resilient material is pasted around the edges of the cutouts 32. The cut-outs 32 on the top rail 10 are dimensioned to accept and seamlessly fit the cutouts 32 from a bottom rail 20. The upper edge of the first short side and the second short side project slightly above the top side to embody a fin 34. The top side possesses two semi-circular crevices 12 positioned near the fins 34. In fabrication, the crevices 12 are disposed in an opposite manner wherein the curved edge of the crevice 12 is disposed away from the fin 34.

Figure 2:
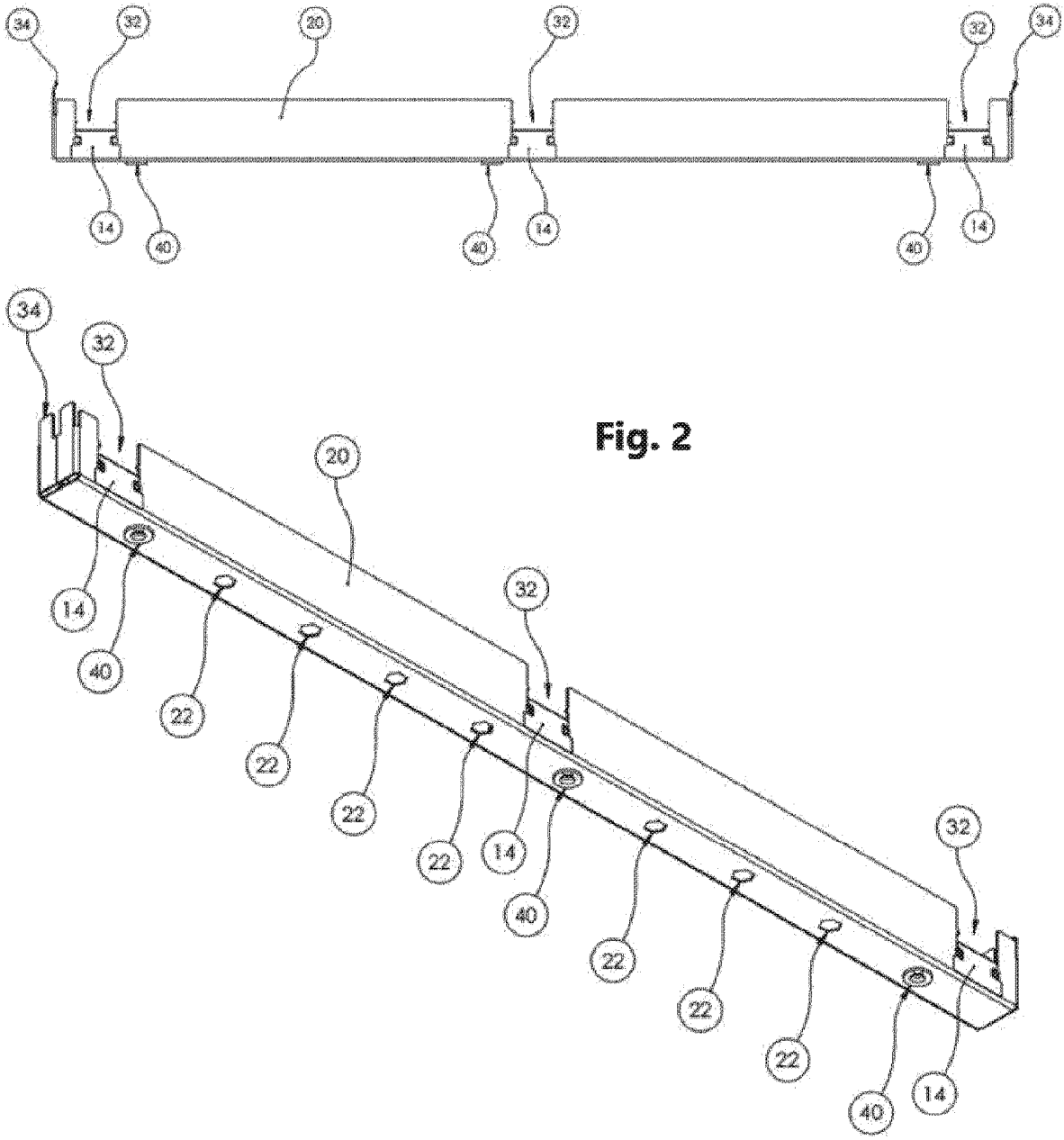
FIG. 2 represents a side orthographic view and a bottom perspective view of the bottom rail.

FIG. 2 shows a bottom rail 20. The bottom rail 20 possesses a first short side and a second short side connected by two opposite long sides and a bottom side in fabrication to embody a five sided elongated strip with flat surfaces and a hollow cavity opening through the top defining a length, a width, and a height. The bottom rail 20 possesses three pairs of cut-outs 32 positioned coincidentally on the two opposite long sides along the hollow cavity such that two pairs of coincidental cut-outs 32 are positioned near the first short side and the second short side, and one pair of coincidental cut-outs 32 is positioned approximately at the center of the bottom rail 20. A pair of coincidental cut-outs 32 will be referred to as a 'cut-out' 32 hereon. A tape 14 fabricated of shock-absorbing slightly resilient material is pasted around the edges of the cutouts 32. The cut-outs 32 on the bottom rail 20 are dimensioned to accept and seamlessly fit the cut-outs 32 on the top rail 10. The upper edge of the first short side and the second short side project slightly above the upper edges of the two opposite long sides to embody a fin 34. The bottom side of the bottom rail 20 possess a series hexagonal shaped slots 22 located at uniform intervals along the length.

Figure 3:
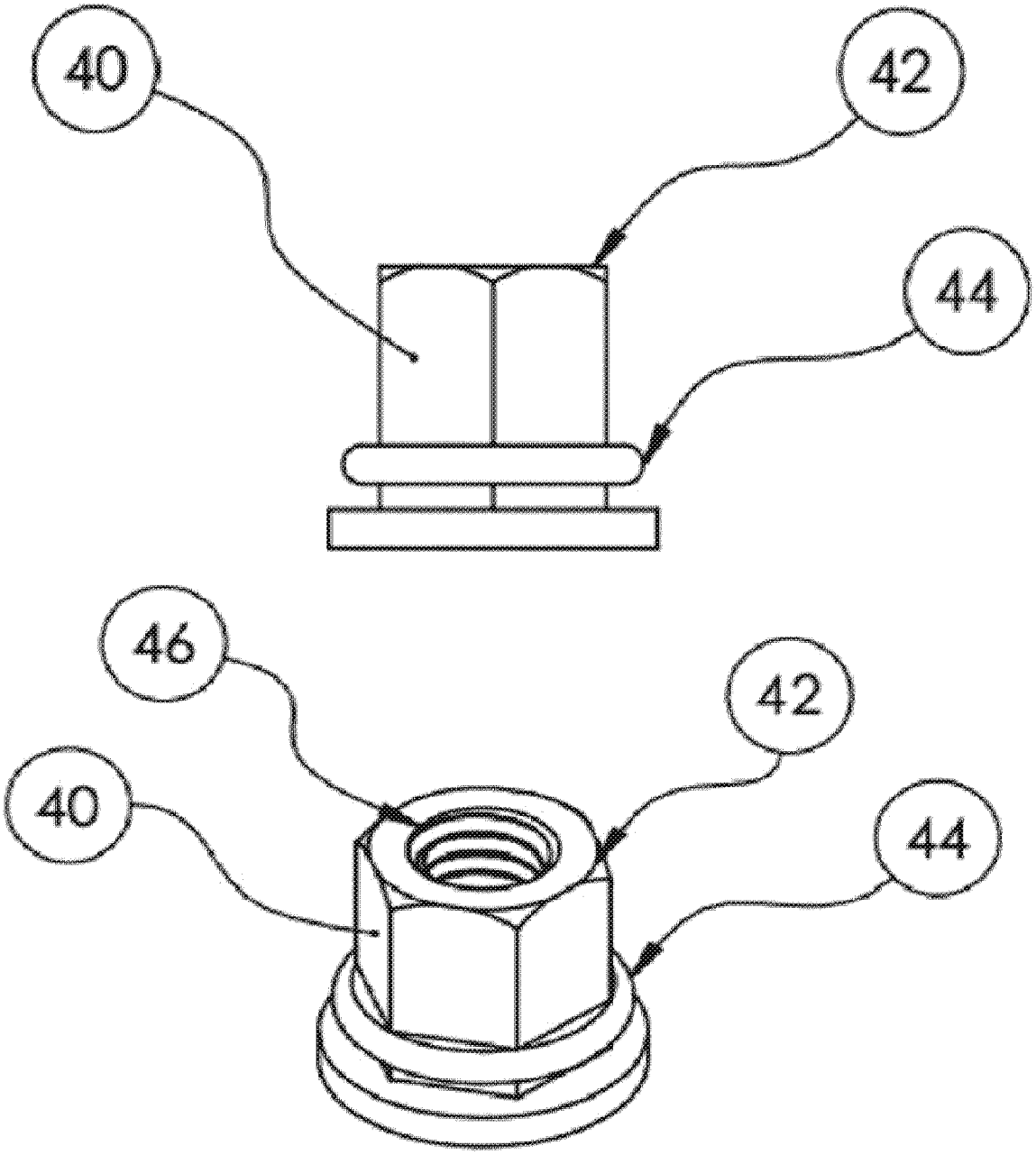
FIG. 3 represents a side orthographic view and an isometric view of the rivet.

FIG. 3 shows a rivet 40. The rivet 40 possesses an internal threaded bore 46 and an outer hexagonal shaped body with a rim 44 extending radially outward along the midsection. The threaded bore 46 is dimensioned to accept a foot 58 with matching threads. The outer hexagonal shaped body is dimensioned to fit the slots 22 on the bottom rails 20 and the rim 44 ensconces on the surface of the bottom rail 20 keeping the rivet 40 from falling through when inserted into a slot 22.

Figure 4:
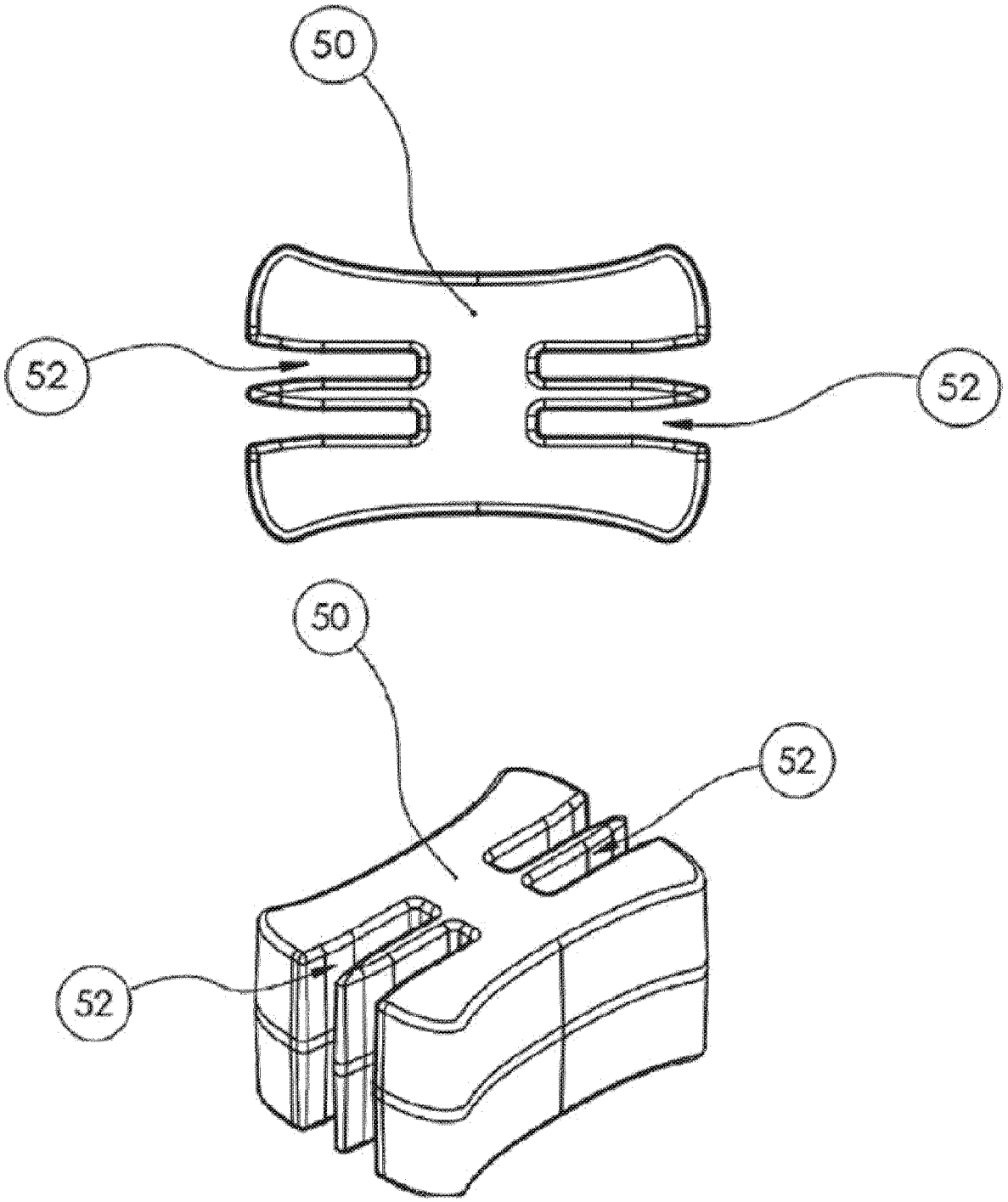
FIG. 4 represents a side orthographic view and an isometric view of the spacer.

FIG. 4 shows a spacer 50. The spacer 50 possesses a cuboidal shape with a first side and a second side separated by a thick mid-section. The spacer possesses slits 52 carved on the first side and the second side. The spacer 50 acts as a connector between base frameworks and provides a uniform gap between adjacent base frameworks. The spacer 50 being fabricated of an elastomer composes a rigid deformable shape, high tensile strength and is slightly resilient. The spacer 50 also acts as a shock inhibitor and helps retaining the tile 64 in position. The slits 52 of the spacer 50 are dimensioned to perfectly fit over the fins 34 on the top rail 10 and bottom rail 20.

Figure 5:
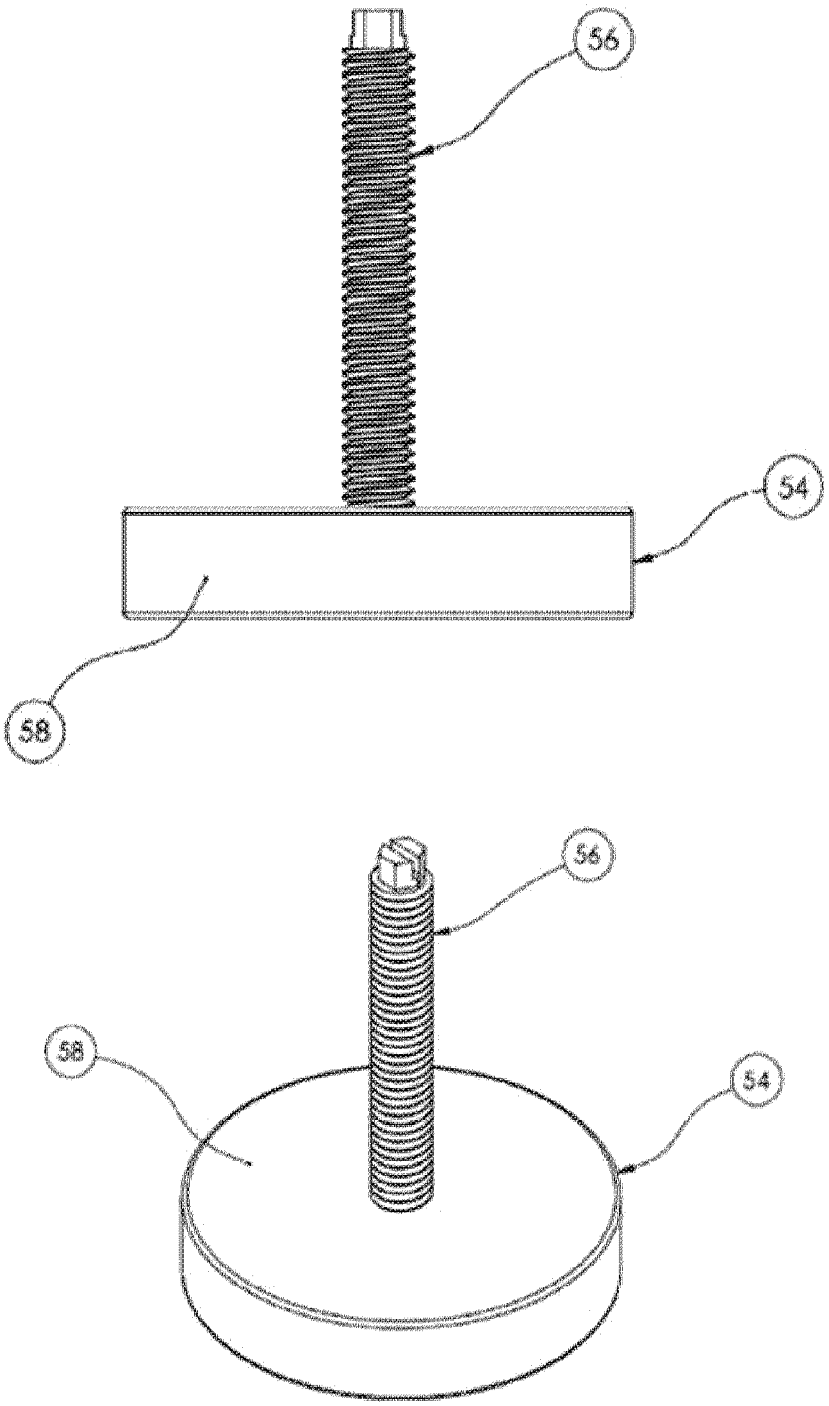
FIG. 5 represents a side orthographic view and an isometric view of the foot.

FIG. 5 shows a foot 58. The foot 58 possesses a flat base 54 with a threaded stem 56 extending upwardly from the center of the base 54. The stem 56 is dimensioned to fit the threaded bore 46 of the rivet 40 such that the foot 58 can be rotatable, allowing it to be moved upward and downward through the rivet 40.

Figure 6:
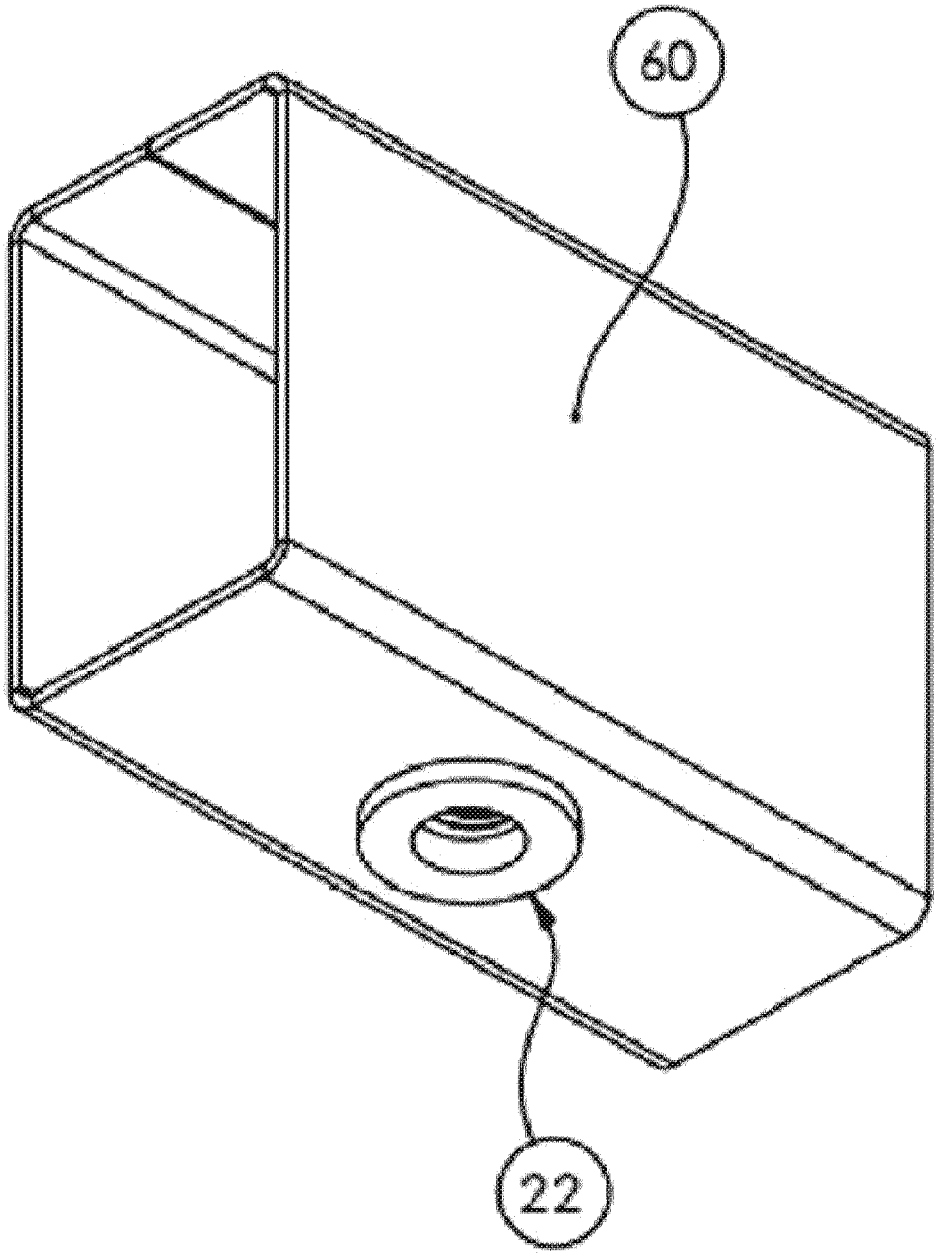
FIG. 6 represents an isometric view of a free-support.

FIG. 6 shows a free-support 60. The free-support 60 possesses a hollow box shape with similar width and height as the top rail 10 and bottom rail 20 of the present embodiment. The free support 60 possesses a hexagonal shaped slot 22 centrally located on the bottom surface. The slot 22 on the free-support 60 is similar to the slots 22 on the bottom rail 20 and is dimensioned to accept and fit a rivet 40.

Figure 7:
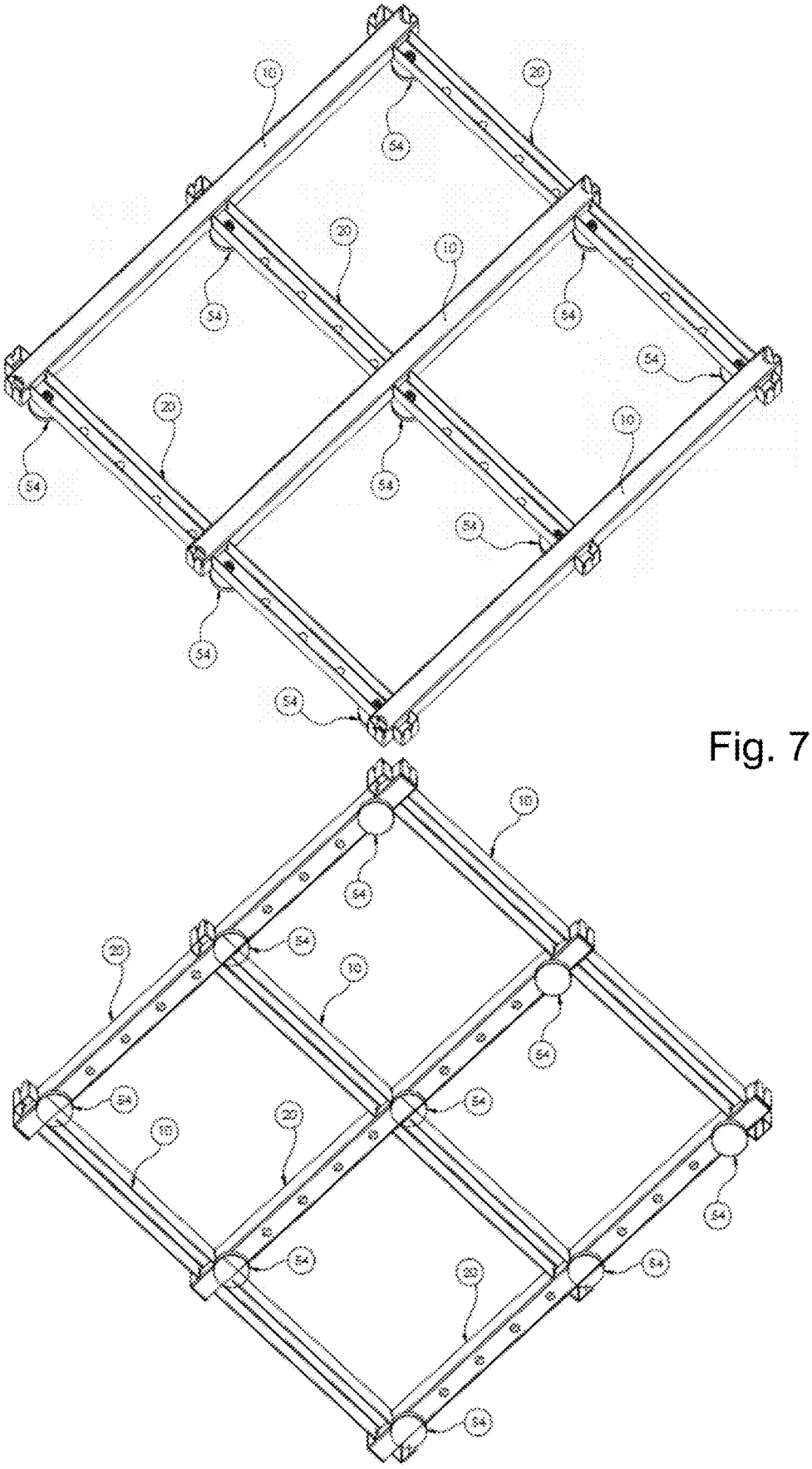
FIG. 7 represents a top and bottom orthographic view of a constructed assembly.
Figure 8:
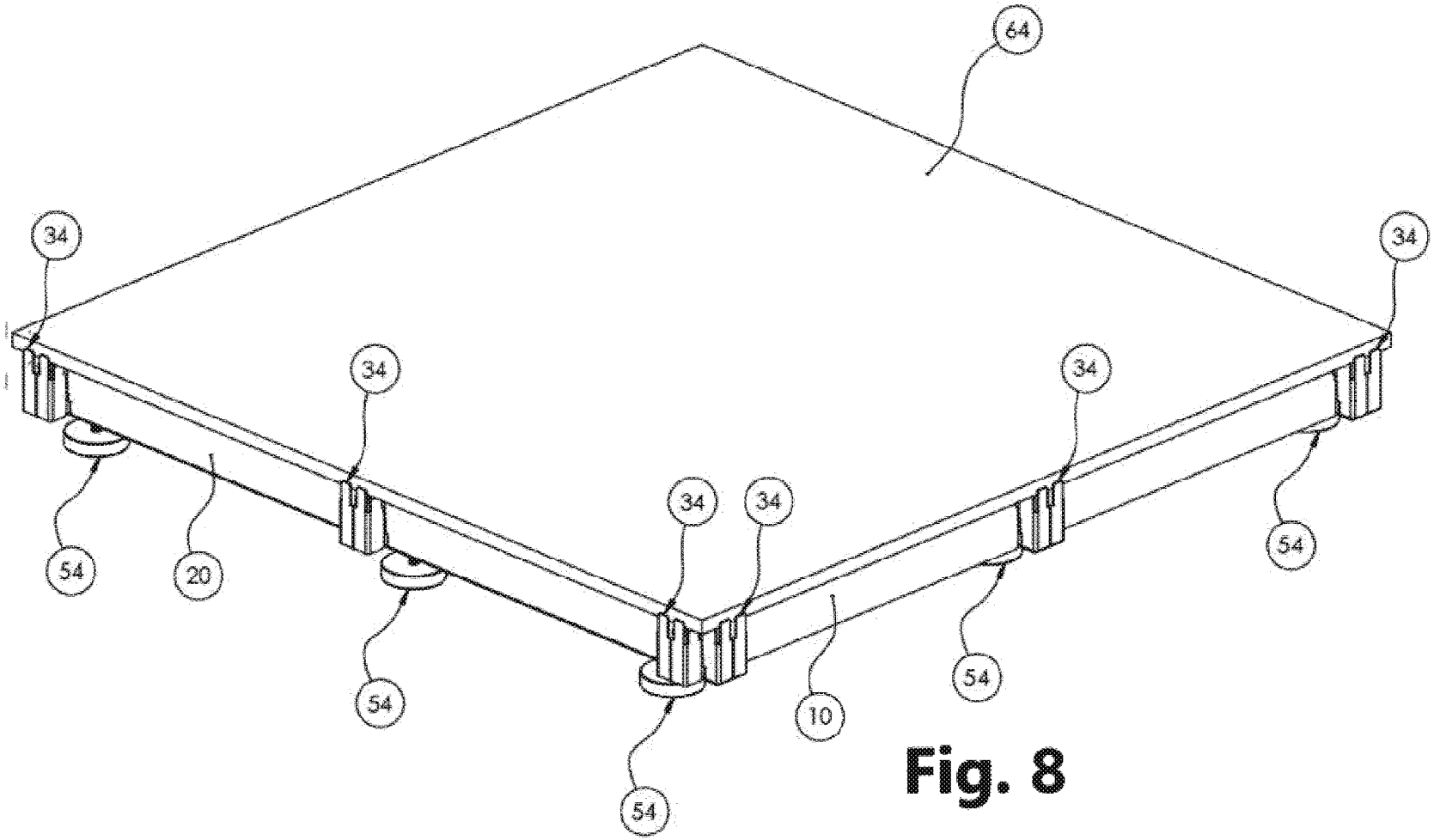
FIG. 8 represents an isometric view of a single constructed assembly with a tile.
Figure 9:
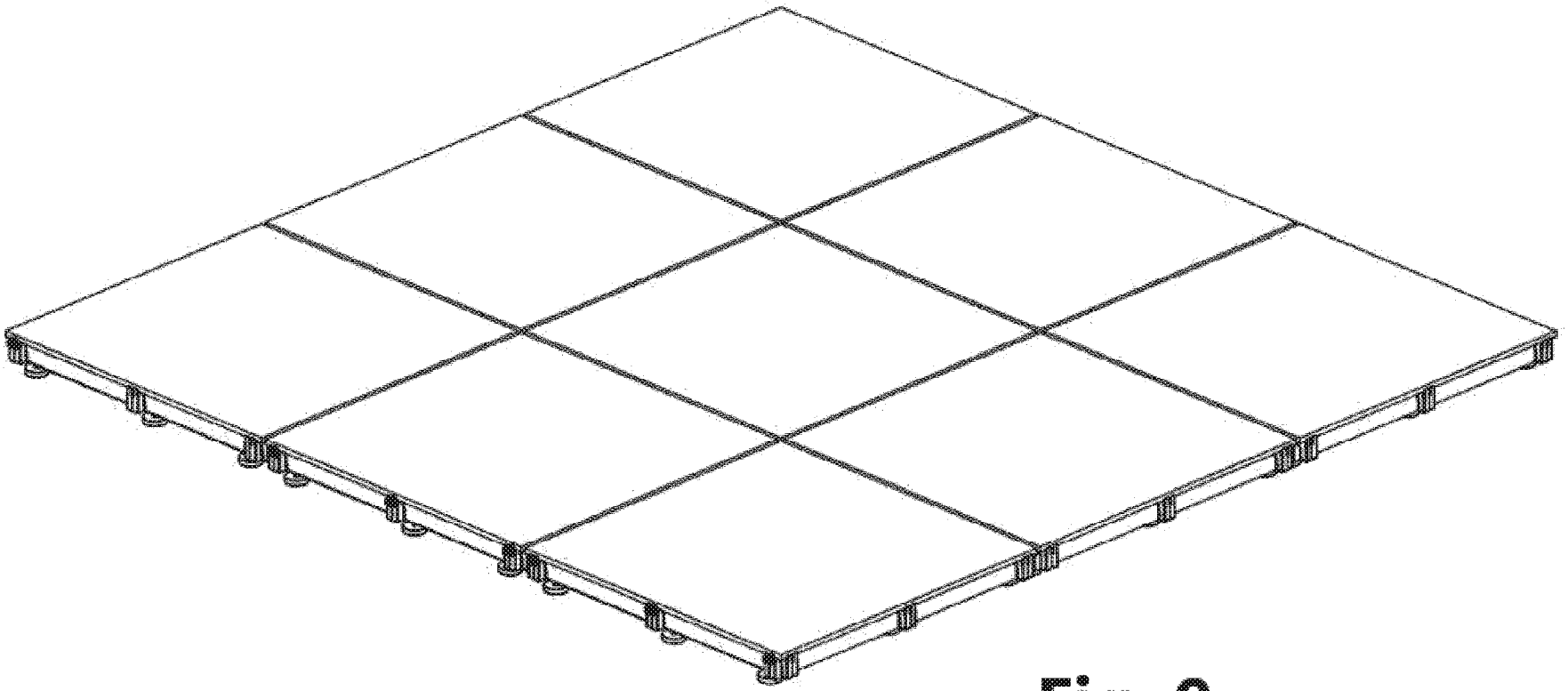
FIG. 9 represents an isometric view of multiple fully constructed system with tiles.

Referring through FIG. 7-FIG. 9, the system of structural support framework in the present embodiment employs a square-shaped tile 64, or a tile 64 with equal length and width. Hence the system employs top rails 10 and bottom rails 20 of equal lengths. Three bottom rails 20 and three top rails 10 are connected such that the cut-outs 32 on the top rails 10 perpendicularly connect with the cut-outs 32 on the bottom rails at a right angle. The slots 22 on the bottom rails 20 are inserted with three rivets 40 each such that two rivets 40 are inserted in the slots 22 closest to the first short side and second short side and one rivet 40 is inserted in a slot located approximately at the center of the bottom rail 20. Each rivet 40 is inserted with a foot 58 such that the stem 56 of the foot 58 is rotatably inserted upwardly into the bore 46 of the rivet 40 and the base 54 of the foot 58 remains below the bottom rail 20 contacting the fixed surface. Three top rails 10, three bottom rails 20, nine rivets 40 and nine foots 58 are assembled in the above manner to embody a stable square-shaped base framework possessing two top rails 10 and two bottom rails 20 as each side and one top rail 10 and one bottom rail 20 intersecting at the center. The height of the base framework can be calibrated by rotating the foot 58 up or down inside the rivets 40 until the required height and slope is attained. A plurality of base frameworks is constructed and laid adjacently over the fixed surface such that the top rails and bottom rails of the corresponding base frameworks linearly align. A spacer 50 is employed to connect the base frameworks. The slits 52 on first side of the spacer 50 are inserted onto the fins 34 of the top rails 10 and bottom rails 20 of one base framework until the top surface of the spacer 50 seamlessly aligns with the edge of the fin 34, thus defining a limiter, hereon referred to the part of the spacer 50 along the inner edge of the top rails 10 and bottom rails 20. The slits 52 on the second side of the spacer 50 are inserted onto the fins 34 of the top rails 10 and bottom rails 20 of an adjacent base framework thus connecting the two base frameworks together. The thick mid-section of the spacer 50 ensures uniform gap between the base frameworks and aids in shock absorption. The connection of all base frameworks with spacers concludes the completion of the system of structural support framework of the present invention. A tile can be conveniently disposed onto the corresponding base framework. The limiter of the spacer 50 holds the tile 64 in position ensuring a tight fit. In pragmatic scenarios, the base framework might be too broad to be accommodated in certain areas specially around the corners, edges, beams, and other obstructions. The base framework may need to alter in order to accommodate such areas which can be achieved using standard cutting or snipping tools & equipment. An altered base framework might lose considerable support; a free-support 60 can be employed in such scenarios. For example, a base framework altered to accommodate a corner, a plurality of free-supports 60 can be used wherein the slot on each free-support 60 is inserted with a rivet 40 and foot 58. The height of the free-support 60 is calibrated by rotating the foot 58 up or down in the rivet 40 to match the height of the corresponding base framework. The free-support 60 can then be conveniently disposed into the hollow cavity of the top rail 10 where the framework is altered and added as an extra support for the tile 64. In cases where the tile 64 needs to be removed or extricated, the crevices 12 on the top rail 10 provide sufficient room to insert any standard flat tool to extricate the tile 64 off the base framework. The elevated floor, thus constructed by employing the system of structural support framework of the present embodiment can be applied in indoors as well as outdoor applications. The system provides sufficient height for air and water flow where required by code, and for electrical or mechanical maintenance and installation. The shock-absorbing tape 14 on the top rails 10 and bottom rails 20 abstains the creaking noise between the components. The system can be conveniently deconstructed by extricating the tiles 64 and disassembling each component. The deconstructed framework can be reused or recycled responsibly.

A System of Structural Support Framework for Elevated Flooring According to Alternative Embodiments The invention disclosed herein may also be applied in scenarios wherein a tile 64 possesses different length and width. In a case of a rectangular tile, where the length of the tile 64 is more than the width, a base framework that incorporates variant dimensions of top rails 10 and bottom rails 20 can be applied, such that when constructed, the base framework possesses a rectangular shape. Similarly, in a case where a tile 64 possesses a triangular or a hexagonal shape, the top rails 10 and bottom rails 20 with non-coincidental cut-outs 32 can be employed, such that connection of the top rails 10 and the bottom rails 20 at the cut-outs 32 is made at an acute or obtuse angle. Thus, allowing it to connect the top rails 10 and bottom rails 20 to construct a base framework of triangular or hexagonal shape to accommodate a triangular or hexagonal tile 64 respectively. In a case of a tile 64 where the tile 64 is longer, broader or heavier than a regular tile 64, a longer measure of top rails 10 or bottom rails 20 can be applied with more than three cut-outs 32 on each top rail 10 and bottom rail 20. In this case, each base framework can be constructed using more than three units of top rails 10 or bottom rails 20, rivet 40 and foots 58 to accommodate a longer, broader or heavier tile 64. The rivets 40 of an alternative embodiment may possess a different outer shaped body specifically having a circular or quadrilateral shaped body. Similarly, the slots 22 on the bottom rails 20 may possesses circular or quadrilateral shape to fit rivets 40 of respective dimensions. The stem 56 of the foot 58 may be further connected to the flat base 54 with a ball-joint, wherein the flat base 54 of the foot 58 aligns seamlessly with the fixed surface at the bottom when placed on a slope. The overall system of connection and height calibration remains the same in all embodiments. The embodiments of the invention can be fabricated by alloys as well as organic materials.

The embodiments of the invention in which an exclusive property or privilege is claimed are defined as follows:

1. A system of structural support framework for elevated flooring, comprising:

a plurality of base frameworks disposed adjacently over a fixed surface, each base framework of the plurality of base frameworks comprising a quadrilateral shape having four sides dimensioned to accept and dispose a quadrilateral shaped tile, each base framework of the plurality of base frameworks having a height and a slope, each base framework of the plurality of base frameworks comprising:

a plurality of top rails, each of the plurality of top rails comprising a first short side and a second short side connected by two opposite long sides and a top side embodying a five sided elongated strip with flat surfaces and a hollow cavity opening at a bottom thereby defining a length, a width and a height, each top rail comprising at least three pairs of coincidental cut-outs along the hollow cavity on the two opposite long sides, a shock-absorbing tape around the at least three pairs of coincidental cut-outs, each top rail comprising a fin along the first short side projecting above a top side, each top rail comprising a fin along the second short side projecting above the top side, each top rail comprising a semi-circular crevice along the fin;

a bottom rail, the bottom rail comprising a first short side and a second short side connected by two opposite long sides and a bottom side embodying a five sided elongated strip with flat surfaces and a hollow cavity opening at the top thereby defining a length, a width and a height, the bottom rail comprising a same length, width and height as one of the plurality of top rails, the bottom rail comprising at least three pairs of coincidental cut-outs along the hollow cavity on the two opposite long sides, a shock-absorbing tape around the at least three pairs of coincidental cut-outs, the bottom rail comprising a fin along the first short side projecting above an upper edge of the two opposite long sides, the bottom rail comprising a fin along the second short side projecting above the upper edge of the two opposite long sides, the bottom rail comprising a series of hexagonal slots on a bottom side located at a uniform interval;

a rivet, the rivet comprising an inner threaded bore and an outer hexagonal shaped body, the rivet comprising a rim extending radially outward along a mid-section of the outer hexagonal shaped body, the rivet dimensioned to fit the series of hexagonal slots on the bottom rail such that the rim of the rivet ensconces on a surface of the bottom rail when inserted into the series of hexagonal slots; and a foot, the foot comprising a flat base and a threaded stem extending upwardly from a center of the flat base, the threaded stem dimensioned to fit the inner threaded bore of the rivet such that the foot can be rotatably inserted into the rivet;

a plurality of spacers, each spacer of the plurality of spacers comprising a cuboidal shape with a first side and a second side separated with a mid-section, each spacer of the plurality of spacers comprising slits on the first side and the second side, each spacer of the plurality of spacers being composed of an elastomer comprising a tensile strength, the slits on each spacer of the plurality of spacers dimensioned to seamlessly fit over the fin on the top rails and bottom rail; and a plurality of free-supports, each free-support of the plurality of free-supports comprising a hollow box-shaped body, each free-support of the plurality of free-supports having a hexagonal slot centrally located on a bottom side.

2. The system of claim 1, wherein the plurality of base frameworks are constructed with at least three top rails perpendicularly connected to at least three bottom rails such that the at least three pairs of coincidental cut-outs on the plurality of top rails seamlessly fit into the at least three pairs of coincidental cut-outs on the at least three bottom rails at a right angle.

3. The system of claim 2, wherein the plurality of base frameworks comprises a quadrilateral shape having two top rails and two bottom rails as each side and at least one top rail and at least one bottom rail intersecting at a center of the plurality of top rails or the at least three bottom rails.

4. The system of claim 3, wherein the series of hexagonal slots of each of the at least three bottom rails on the plurality of base frameworks are inserted with at least three rivets such that two rivets are inserted into a hexagonal slot of the series of hexagonal slots closest to the first short side and the second short side of the at least three bottom rails and one rivet is inserted into a hexagonal slot of the series of hexagonal slots approximately at a center of the at least three bottom rails.

5. The system of claim 4, wherein each rivet is inserted with a foot such that the threaded stem of the foot is rotatably inserted upwardly into the inner threaded bore of the rivet and the flat base of the foot remains below the at least three bottom rails and contacts the fixed surface.

6. The system of claim 5, wherein a plurality of base frameworks are laid adjacently over the fixed surface such that the plurality of top rails and the at least three bottom rails of corresponding base frameworks linearly align.

7. The system of claim 6, wherein the plurality of base frameworks are connected with the plurality of spacers such that the slits on the first side of a spacer of the plurality of spacers are inserted onto the fins of the plurality of top rails and the at least three bottom rails of one base framework and the slits on the second side of the spacer are inserted onto the fins of the top rails and the at least three bottom rails of an adjacent base framework.

8. The system of claim 7, wherein the height and the slope of the base plurality of base frameworks is calibrated by rotating the foot inside the rivet.

9. The system of claim 8 wherein a plurality of quadrilateral shaped tiles are disposed over a corresponding base framework.

10. The system of claim 1, wherein the series of hexagonal slots on the plurality of free-supports are inserted with a rivet such that the rim of the rivet ensconces on a surface of the plurality of free-supports, the foot is rotatably inserted upwardly into the rivet, the plurality of free-supports can be disposed along the plurality of base frameworks at one or more locations.

11. The system of claim 1, wherein each base framework of the plurality of base frameworks further comprises a bottom rail of a different length, width, or height from the plurality of top rails.

12. The system of claim 1, wherein each base framework of the plurality of base frameworks further comprises circular or quadrilateral shaped slots on the bottom rail.

13. The system of claim 1, wherein each base framework of the plurality of base frameworks each further comprises a rivet with an inner threaded bore and an outer circular or quadrilateral shaped body with a rim extending radially outwards from a mid-sector of an outer body.

14. A system of structural support framework for elevated flooring, comprising:

a plurality of base frameworks disposed adjacently over a fixed surface; each base framework of the plurality of base frameworks comprising a triangular or hexagonal shape dimensioned to accept and dispose a tile of triangular or hexagonal shape, each base framework of the plurality of base frameworks comprising:

a plurality of top rails, each top rail of the plurality of top rails comprising a first short side and a second short side connected by two opposite long sides and a top side embodying a five sided elongated strip with flat surfaces and a hollow cavity opening at a bottom thereby defining a length, a width and a height, each top rail of the plurality of top rails comprising at least three pairs of non-coincidental cut-outs along the hollow cavity on the two opposite long sides, a shock-absorbing tape around the at least three pairs of non-coincidental cut-outs, each top rail of the plurality of top rails comprising a fin along the first short side projecting above the top side, each top rail of the plurality of top rails comprising a fin along the second short side projecting above a top side, each top rail of the plurality of tops rails comprising a semi-circular crevice along the fin;

a bottom rail, the bottom rail comprising a first short side and a second short side connected by two opposite long sides and a bottom side embodying a five sided elongated strip with flat surfaces and a hollow cavity opening at the top thereby defining a length, a width and a height, the bottom rail comprising at least three pairs of non-coincidental cut-outs along the hollow cavity on the two opposite long sides, a shock-absorbing tape around the at least three pairs of non-coincidental cut-outs, the bottom rail comprising a fin along the first short side projecting above an upper edge of the two opposite long sides, the bottom rail comprising a fin along the second short side projecting above the upper edge of the two opposite long sides, the bottom rail comprising a series of hexagonal slots on the bottom side located at a uniform interval;

a rivet, the rivet comprising an inner threaded bore and an outer hexagonal shaped body, the rivet comprising a rim extending radially outward along a mid-section of the outer hexagonal shaped body, the rivet dimensioned to fit the series of hexagonal slots on the bottom rail such that the rim of the rivet ensconces on a surface of the bottom rail when inserted into the series of hexagonal slots; and a foot, the foot comprising a flat base and a threaded stem extending upwardly from a center of the flat base, the threaded stem dimensioned to fit the inner threaded bore of the rivet such that the foot can be rotatably inserted into the rivet.

15. The system of claim 14, wherein each base framework of the plurality of base frameworks being constructed of at least one top rail connected to at least two bottom rails at the at-least three pairs of non-coincidental cut-outs such that the at least three pairs of non-coincidental cut-outs on the at least one top rail seamlessly fit into the cut-outs on the at least two bottom rails at an acute angle.

16. The system of claim 15, wherein each base framework of the plurality of base frameworks comprises a triangular shape having two bottom rails and one top rail as sides.

17. The system of claim 16, wherein each base framework of the plurality of base frameworks are inserted with at least three rivets such that one rivet is inserted into the series of hexagonal slots on the bottom rail closest to connection of the two bottom rails and two rivets are inserted into the series of hexagonal slots closest to connection of the two bottom rails with the plurality of top rails.

18. The system of claim 14, wherein each base framework of the plurality of base frameworks being constructed of at least four top rails connected to at least four bottom rails at the at least three pairs of non-coincidental cut-outs such that the at least three pairs of non-coincidental cut-outs on at least one of the plurality of top rails seamlessly fit into the at least three pairs of non-coincidental cut-outs on the at least four bottom rails at an obtuse angle.

19. The system of claim 18, wherein each of the plurality of base frameworks comprises a hexagonal shape having four top rails connected to four bottom rails such that three top rails and three bottom rails form each side of each of the plurality of base frameworks and one top rail and one bottom rail intersect at a center of a top rail or a bottom rail of the four bottom rails.

20. The system of claim 19, wherein each of the plurality of base frameworks are inserted with at least seven rivets such that each rivet is inserted into the series of hexagonal slots on the at least four bottom rails closest to connection of the plurality of top rails and the at least four bottom rails and one rivet is inserted into the series of hexagonal slots on the at least four bottom rails intersecting at least top rails of the plurality of top rails at a center of the plurality of top rails.

* * * * *